US011058206B2

(12) United States Patent
Shen

(10) Patent No.: US 11,058,206 B2
(45) Date of Patent: Jul. 13, 2021

(54) DOUBLE-SPIRAL LIPSTICK TUBE

(71) Applicant: APR Beauty Group Inc., Toronto (CA)

(72) Inventor: Jun Shen, New Westminster (CA)

(73) Assignee: APR BEAUTY GROUP INC., Toronto (CA)

( * ) Notice: Subject to any disclaimer, the term of this patent is extended or adjusted under 35 U.S.C. 154(b) by 0 days.

(21) Appl. No.: 16/682,153

(22) Filed: Nov. 13, 2019

(65) Prior Publication Data

US 2020/0297097 A1 Sep. 24, 2020

(30) Foreign Application Priority Data

Mar. 18, 2019 (CN) ..... 201920335873.6

(51) Int. Cl.

| | |
|---|---|
| ***B43K 21/08*** | (2006.01) |
| ***A45D 40/04*** | (2006.01) |
| ***A45D 40/06*** | (2006.01) |
| *A45D 40/20* | (2006.01) |

(52) U.S. Cl.

CPC ..... *A45D 40/04* (2013.01); *A45D 40/06* (2013.01); *A45D 40/065* (2013.01); *A45D 2040/208* (2013.01)

(58) Field of Classification Search

CPC ..... A45D 40/04; A45D 40/06; A45D 40/065; A45D 2040/208

USPC ..... 401/75, 78

See application file for complete search history.

(56) References Cited

U.S. PATENT DOCUMENTS

| | | | | |
|---|---|---|---|---|
| 5,172,993 | A * | 12/1992 | Ackermann | A45D 40/04 401/69 |
| 5,813,421 | A * | 9/1998 | Wang | A45D 40/04 132/318 |
| 9,930,953 | B2 * | 4/2018 | Liard | A45D 40/06 |
| 2005/0163554 | A1 * | 7/2005 | Cara Sanchez | A45D 40/04 401/69 |

* cited by examiner

*Primary Examiner* — Jennifer C Chiang

(57) ABSTRACT

A double-spiral lipstick tube that is small-sized but can accommodate a standard volume of a paste body product. The double-spiral lipstick includes a tube body that houses an outer screw member and an inner screw member embedded inside the outer screw member. The double-spiral lipstick also includes a middle segment that is axially fixed to and circumferentially slidable relative to the outer screw member. The double-spiral lipstick further includes a bead having a barrel body for housing the paste body. A lower portion of the bead extends into the inner portion of the inner screw member. The rotation of the tube body causes rotation of the outer screw member and the inner screw member, which in turn pushes the bead and the inner screw member to move up together up to a certain distance, and thereafter on a continuous rotation of the tube body, only the bead moves up.

8 Claims, 8 Drawing Sheets

DOUBLE-SPIRAL LIPSTICK TUBE

TECHNICAL FIELD

The present invention relates to the field of cosmetic packaging, and in particular to a double-spiral lipstick tube.

BACKGROUND ART

With the improvement of living conditions, people need to carry more and more items with them when they go out, so the items in small size are more convenient to carry. Lipstick is generally a cosmetic that women carry with them for makeup at any time. At present, the lipstick tube on the market mostly has a single-spiral structure and a short stroke, if the amount of a paste body contained in the lipstick tube is to be increased, the volume of the lipstick tube needs to be increased, making the lipstick occupy a large space and be inconvenient to carry, so the technician develops a lipstick tube that is small in size and ensures the volume of the paste body contained, making it easy to carry around.

SUMMARY OF THE INVENTION

An object of the present invention is to overcome the above deficiencies of the prior art, and to provide a double-spiral lipstick tube, which has an increased stroke but a small size and is convenient to carry.

In order to achieve the above object, the present invention uses the following technical solution:

a double-spiral lipstick tube, which comprises a cap and a tube body snapped vertically to each other, an outer screw member engaged and fixed inside the tube body, an inner screw member embedded inside the outer screw member, a middle segment axially fixed to and circumferentially slidable relative to the upper portion of the outer screw member, a lifting member slidably sheathed on the middle segment, a bead whose lower portion passes through the lifting member and extends into the inner portion of the inner screw member, and a bushing whose lower portion extends into the tube body and is fixedly connected to the outer wall of the middle segment, wherein the inner wall of the outer screw member is provided with an outer guiding groove, the outer wall of the lower portion of the inner screw member is provided with protruding posts, the inner screw member is rotatably connected to the outer screw member via the protruding posts and the outer guiding groove, the bead comprises a push rod at a lower portion, the inner wall of the inner screw member is provided with an inner guiding groove, the outer wall of the lower portion of the push rod is provided with rotating posts, and the bead is rotatably connected to the inner screw member via the rotating posts and the inner guiding groove.

A coloring member for marking the color of the product is embedded in the center of the top of the cap.

The inner wall of the lower portion of the cap is provided with a groove ring, and the outer wall of the upper portion of the tube body is evenly distributed with protruding teeth snapped into the groove ring.

The outer screw member comprises an upper outer screw member and a lower outer screw member which are connected vertically, the outer wall of the lower outer screw member is provided with a limiting ring, and the inner wall of the lower portion of the tube body is provided with a limiting groove into which the limiting ring abuts.

The outer wall of the lower outer screw member is also circumferentially and evenly distributed with outer limiting teeth, and the inner wall of the lower portion of the tube body is circumferentially and evenly distributed with inner limiting teeth engaged to the outer limiting teeth.

The outer wall of the upper outer screw member is provided with several rib rings, the inner wall of the middle segment is provided with several ribs, and the rib rings abut vertically against the ribs to form axial limiting of the middle segment by the outer screw member.

The bead further comprises a barrel body connected to an upper end of the push rod, and the barrel body is located inside the bushing.

The lifting member comprises an upper lifting portion and a pair of side lifting portions symmetrically connected to a lower end surface of the edge of the upper lifting portion, the outer wall of the middle segment is symmetrically provided with a pair of sliding grooves, and the lifting member is slidably connected to the middle segment via the side lifting portions and the sliding grooves.

The beneficial effects of the present invention are: the double-spiral structure doubles the stroke of the bead, and the volume of the double-spiral lipstick tube is smaller than that of the single-spiral lipstick tube when containing the same volume of paste body, which saves on the amount of materials, reduces the costs, and is also convenient to carry around.

Figure 1:
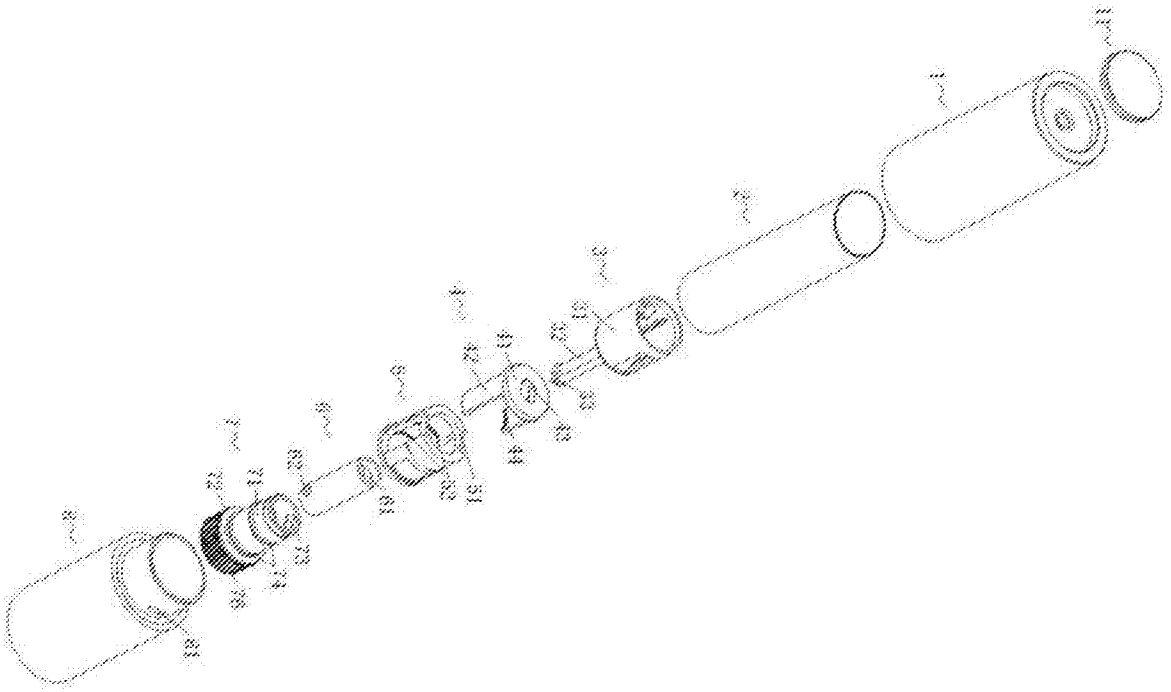
FIG. 1 is an exploded schematic view of the present invention.

In the figures: cap 1, coloring member 11, groove ring 12, bushing 2, bead 3, barrel body 31, push rod 32, rotating post 33, lifting member 4, upper lifting portion 41, side lifting portion 42, limiting hole 43, abutting rib 44, middle segment 5, sliding groove 51, rib 52, inner screw member 6, inner guiding groove 61, protruding post 62, outer screw member 7, upper outer screw member 71, lower outer screw member 72, outer guiding groove 73, rib ring 74, limiting ring 75, outer limiting teeth 76, tube body 8, protruding teeth 81, limiting groove 82, inner limiting teeth 83, paste body 9.

DETAILED DESCRIPTION OF EMBODIMENTS

Figure 2:
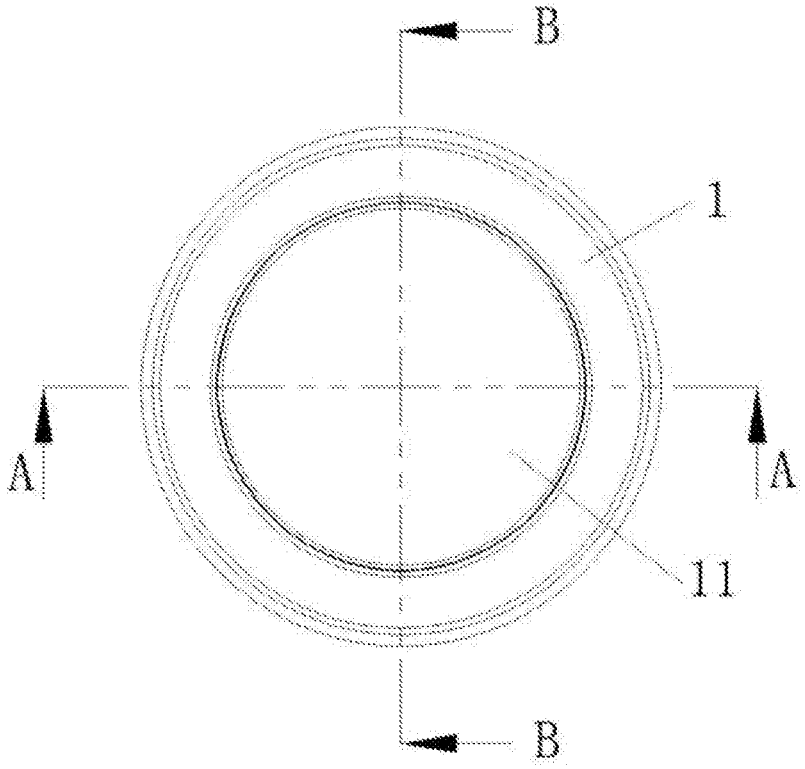
FIG. 2 is a top view of the present invention.
Figure 3:
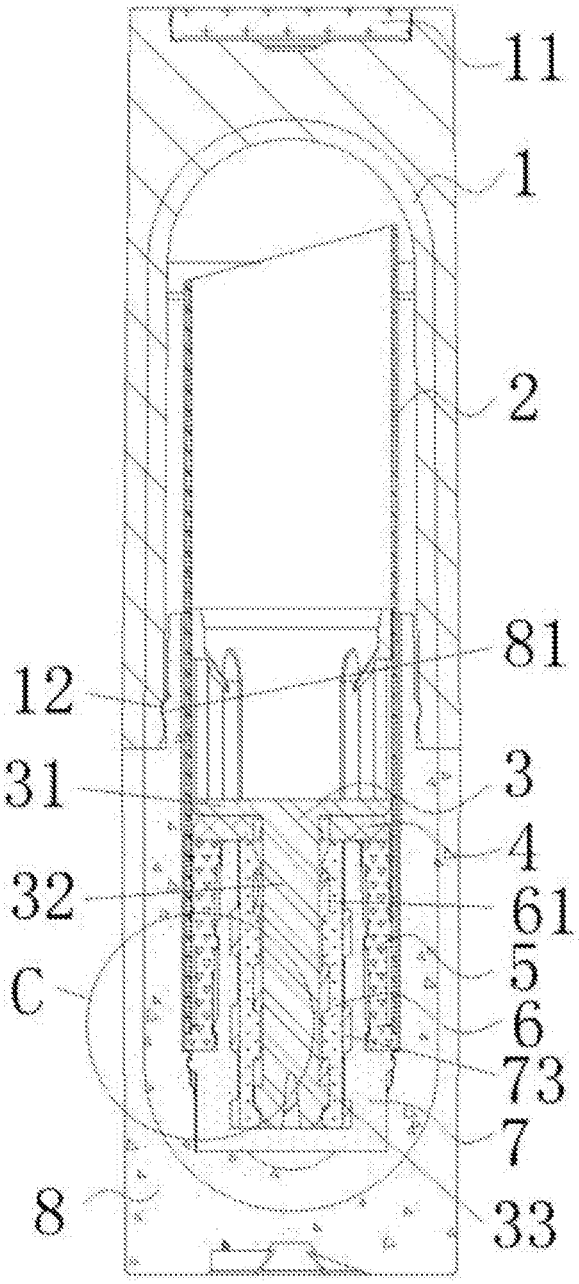
FIG. 3 is a cross-sectional view taken along line A in FIG. 2.
Figure 4:
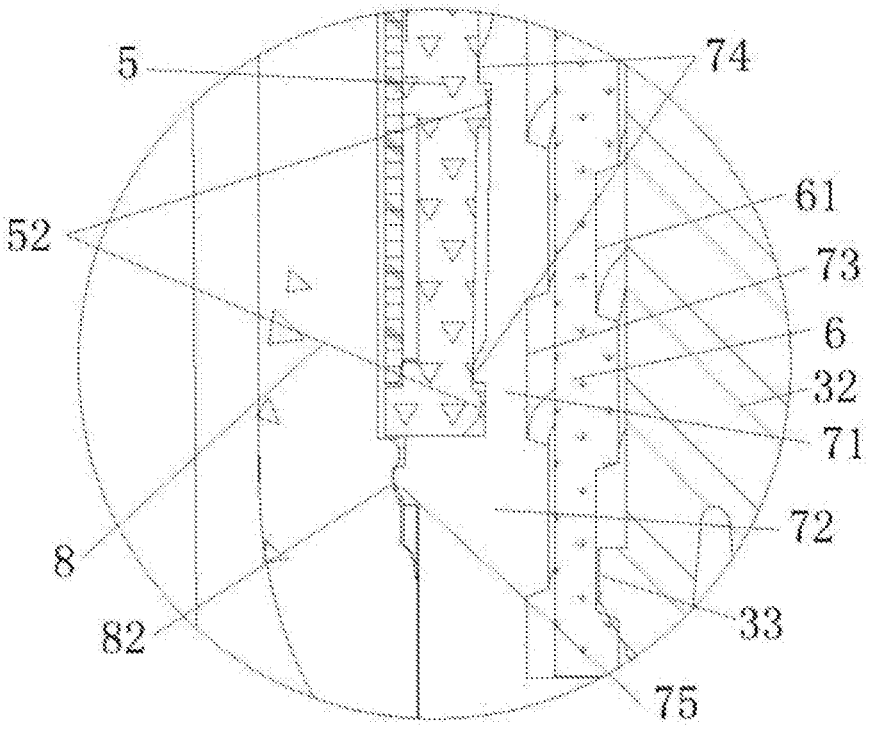
FIG. 4 is an enlarged view of a portion C in FIG. 3.
Figure 5:
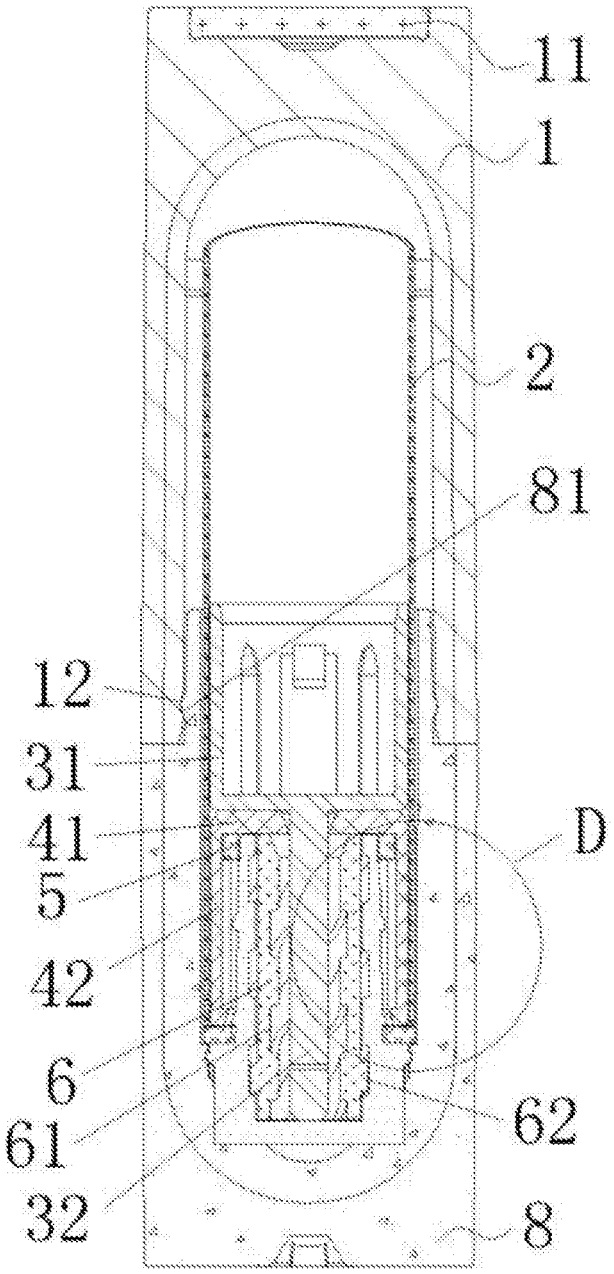
FIG. 5 is a cross-sectional view taken along line B of FIG. 2.
Figure 6:
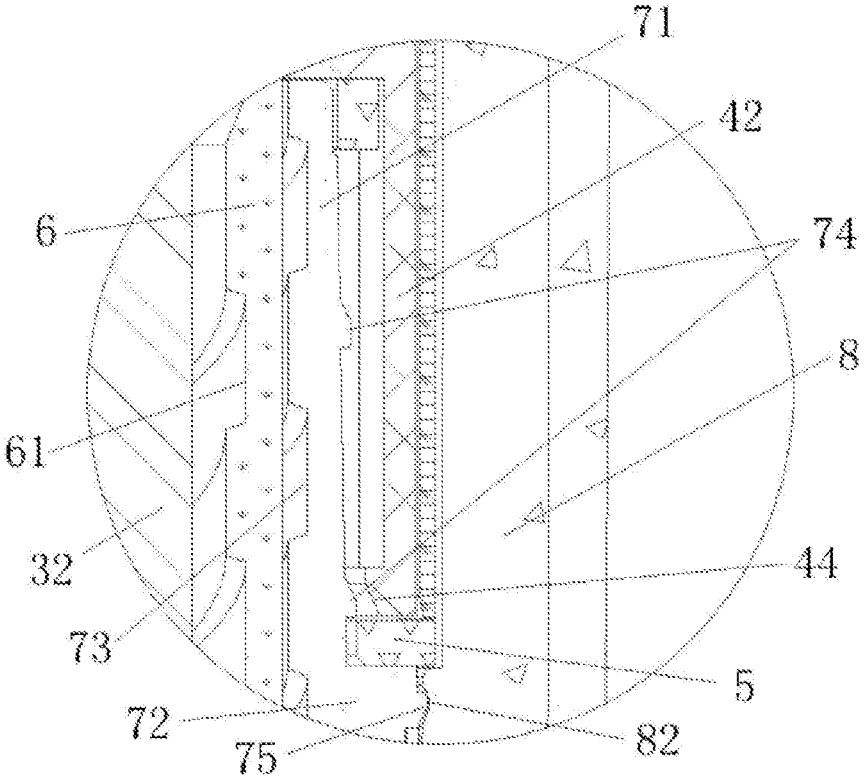
FIG. 6 is an enlarged view of a portion D in FIG. 5.
Figure 7:
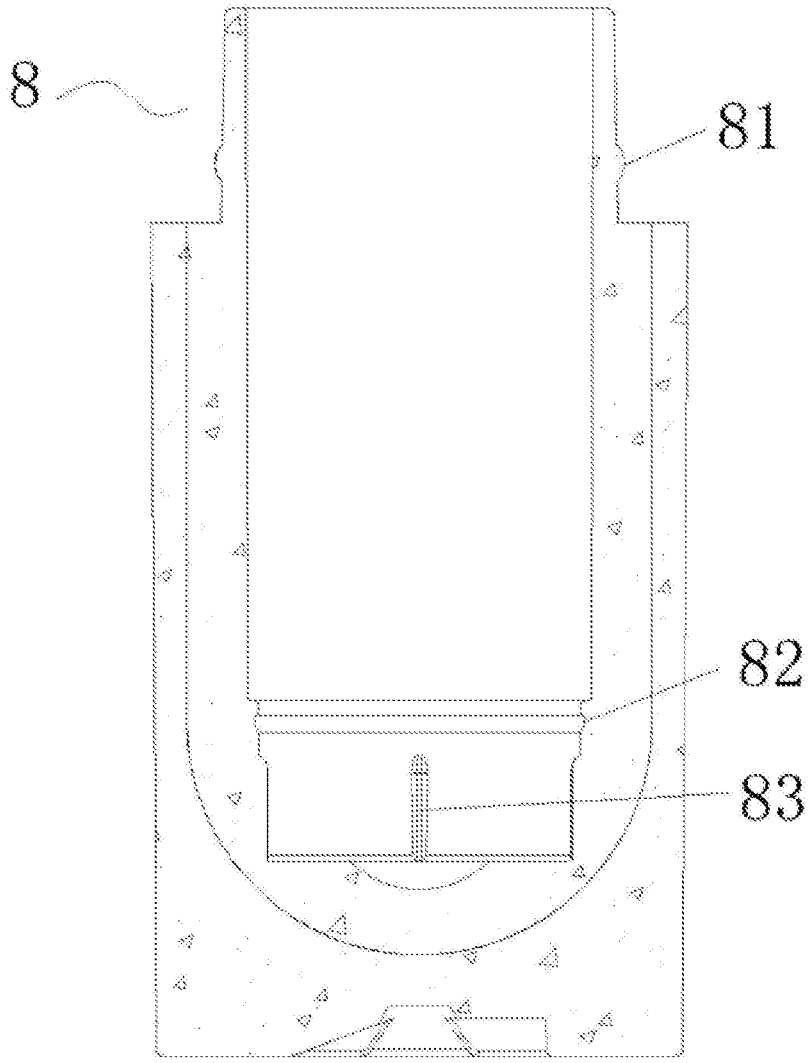
FIG. 7 is a structural schematic view of a tube body of the present invention.
Figure 8:
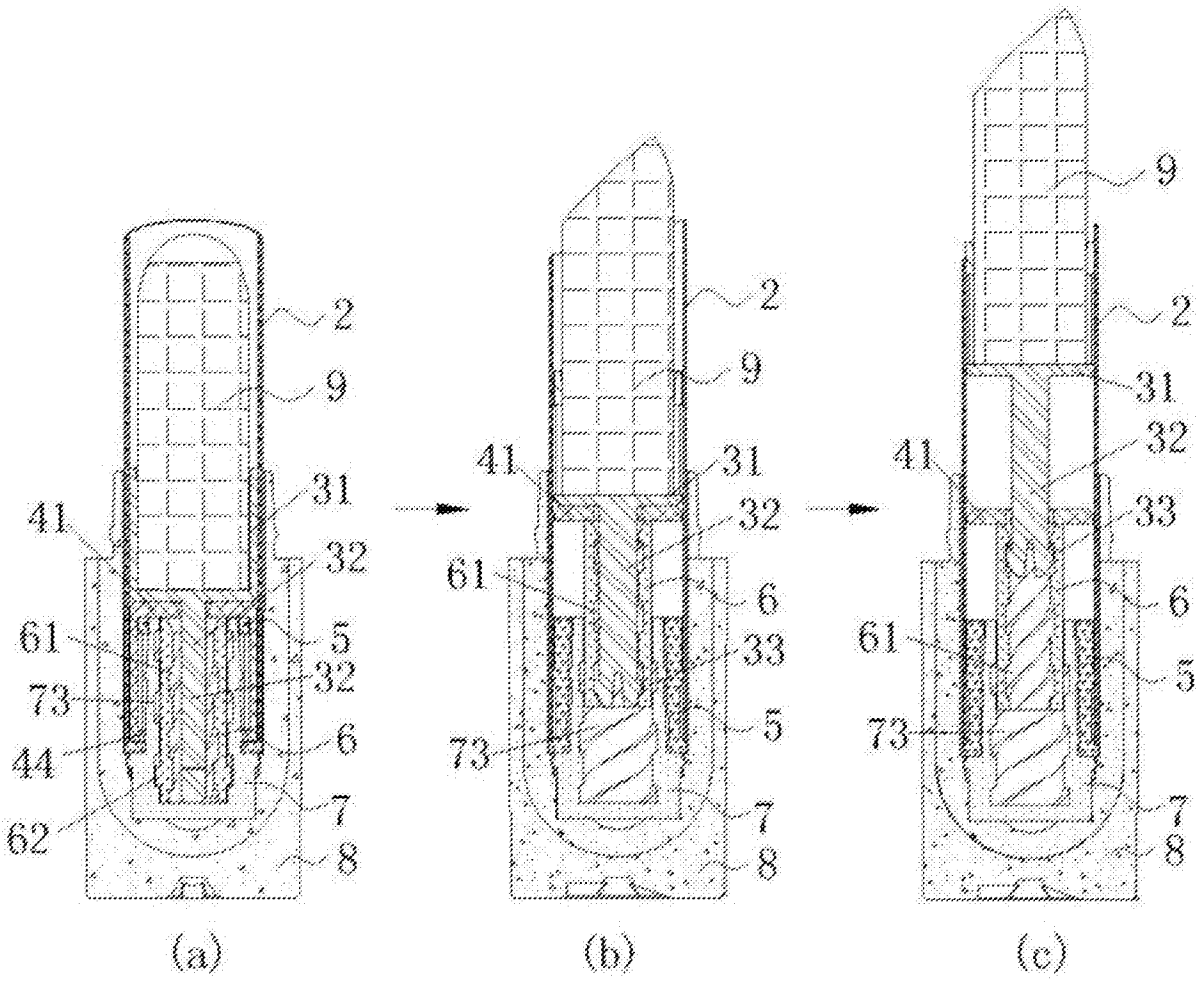
FIG. 8 is a schematic view of the stroke of a paste body of the present invention.

The present invention will be further described below in conjunction with the accompanying drawings and detailed description of embodiments:

as shown in FIGS. 1 to 8, a double-spiral lipstick tube comprises a cap 1 and a tube body 8 snapped vertically to each other, an outer screw member 7 engaged and fixed inside the tube body 8, an inner screw member 6 embedded inside the outer screw member 7, a middle segment 5 axially fixed to and circumferentially slidable relative to the upper portion of the outer screw member 7, a lifting member 4 slidably sheathed on the middle segment 5, a bead 3 whose lower portion passes through the lifting member 4 and extends into the inner portion of the inner screw member 6, and a bushing 2 whose lower portion extends into the tube body 8 and is fixedly connected to the outer wall of the middle segment 5.

A coloring member 11 for marking the color of the product is embedded in the center of the top of the cap 1, the inner wall of the lower portion of the cap 1 is provided with a groove ring 12, the outer wall of the upper portion of the tube body 8 is evenly distributed with protruding teeth 81 snapped into the groove ring 12, the axial fixed connection of the cap 1 and the tube body 8 is realize by the cooperation of the groove ring 12 and the protruding teeth 81, and the covering method is simple and the operation is convenient.

The outer screw member 7 comprises an upper outer screw member 71 and a lower outer screw member 72 which are connected vertically, the upper outer screw member 71 has an outer diameter smaller than the lower outer screw member 72, the outer wall of the lower outer screw member 72 is provided with a limiting ring 75, the inner wall of the lower portion of the tube body 8 is provided with a limiting groove 82 into which the limiting ring 75 is engaged, and the engagement of the limiting ring 75 and the limiting groove 82 forms axial limiting of the outer screw member 7 and the tube body 8. The outer wall of the lower outer screw member 72 is also circumferentially and evenly distributed with outer limiting teeth 76, the outer limiting teeth 76 are disposed under the limiting ring 75, the inner wall of the lower portion of the tube body 8 is circumferentially and evenly distributed with inner limiting teeth 83 engaged to the outer limiting teeth 76, the engagement of the outer limiting teeth 76 and the inner limiting teeth 83 forms circumferential limiting of the outer screw member 7 and the tube body 8, and when the tube body 8 is rotated, the outer screw member 7 rotates along with the rotation of the tube body 8.

The outer wall of the upper outer screw member 71 is provided with several rib rings 74, the inner wall of the middle segment 5 is provided with several ribs 52, and the rib rings 74 abut vertically against the ribs 52 to form axial limiting of the middle segment 5 by the outer screw member 7.

The inner wall of the outer screw member 7 is provided with an outer guiding groove 73, the outer wall of the lower portion of the inner screw member 6 is provided with protruding posts 62, the inner screw member 6 is rotatably connected to the outer screw member 7 via the protruding posts 62 and the outer guiding groove 73, the outer guiding groove 73 has a spiral shape, the protruding posts 62 are set as a pair and are circumferentially symmetric to each other, and the protruding posts 62 are embedded in the outer guiding groove 73 and can spirally move along the outer guiding groove 73.

The bead 3 comprises a push rod 32 at a lower portion, the bead 3 further comprises a barrel body 31 connected to an upper end of the push rod 32, the barrel body 31 is located inside the bushing 2 and circumferentially slidable relative to the bushing 2, and the barrel body 31 is used for containing a paste body 9.

The inner wall of the inner screw member 6 is provided with an inner guiding groove 61, the outer wall of the lower portion of the push rod 32 is provided with rotating posts 33, the bead 3 is rotatably connected to the inner screw member 6 via the rotating posts 33 and the inner guiding groove 61, the inner guiding groove 61 has a spiral shape, the rotating posts 33 are set as a pair and are symmetric to each other, and the rotating posts 33 are embedded in the inner guiding groove 61 and can spirally move along the inner guiding groove 61.

The lifting member 4 comprises an upper lifting portion 41 and a pair of side lifting portions 42 symmetrically connected to a lower end surface of the edge of the upper lifting portion 41, and the inner side of the upper lifting portion 41 is located between the bottom of the barrel body 31 and the upper end of the inner screw member 6, such that when the inner screw member 6 spirally moves up, the lifting member 4 can be pushed up. The center of the upper lifting portion 41 is provided with a limiting hole 43 through which the push rod 32 passes, the center of the lower portion of the push rod 32 is provided with an opening so that the lower portion of the push rod 32 has certain elasticity, and when the bead 3 is assembled, the lower portion of the push rod 32 abuts against the limiting hole 43 to be elastically deformed so that the push rod 32 can smoothly pass through the limiting hole 43 and extend into the inner screw member 6. The inner walls of the lower portions of the side lifting portions 42 are provided with abutting ribs 44, the outer wall of the middle segment 5 is symmetrically provided with a pair of sliding grooves 51, the lifting member 4 is slidably connected to the middle segment 5 via the side lifting portions 42 and the sliding grooves 51, the side lifting portions 42 are embedded into the sliding grooves 51 and can slide vertically along the sliding grooves 51, the side lifting portions 42 can slide upward to the abutting ribs 44 to abut against upper end surfaces of the sliding grooves 51, and the arrangement of the sliding grooves 51 prevents the lifting member 4 from moving up to be disengaged from the middle segment 5.

The outer wall of the middle segment 5 and the inner wall of the lower portion of the bushing 2 can be fixed by means of gluing.

When in use, the cap 1 is removed, the bushing 2 is grabbed by one hand, and the tube body 8 is grabbed by the other hand for circumferential rotation (as shown in FIG. 8*a*); the tube body 8 drives the outer screw member 7 to rotate, the rotation of the outer screw member 7 causes the inner screw member 6 to spirally move up, and then the spiral upward movement of the inner screw member 6 pushes the lifting member 4, the bead 3 and the paste body 9 to gradually move up together (as shown in FIG. 8*b*); and when the abutting ribs 44 move up to abut against the upper end surfaces of the sliding grooves 51, the inner screw member 6 cannot continue to move up as shown in FIG. 8*b*. The tube body 8 is continuously rotated, the circumferential rotation of the outer screw member 7 drives the circumferential rotation of the inner screw member 6, thereby the bead 3 spirally moves up, and the spiral upward movement of the bead 3 pushes the paste body 9 to gradually move up; and when the rotating posts 33 slide to abut against the limiting hole 43, the upward movement cannot be continued, that is, the ejection of the paste body 9 is completed (as shown in FIG. 8*c*). After use, the tube body 8 is rotated in an opposite direction to push the paste body 9 back into the tube body 8.

The above embodiments are merely preferred embodiments of the present invention but not intended to limit the present invention, and any modifications, equivalent replacements, improvements, etc. made within the spirit and principles of the present invention should be included within the scope of protection of the present invention.

The invention claimed is:

1. A double-spiral lipstick tube, which comprises a cap (1) and a tube body (8) snapped vertically to each other, an outer screw member (7) engaged and fixed inside the tube body (8), an inner screw member (6) embedded inside the outer screw member (7), a middle segment (5) axially fixed to and circumferentially slidable relative to the upper portion of the outer screw member (7), a lifting member (4) slidably sheathed on the middle segment (5), a bead (3) whose lower portion passes through the lifting member (4) and extends into the inner portion of the inner screw member (6), and a bushing (2) whose lower portion extends into the tube body (8) and is fixedly connected to the outer wall of the middle segment (5), wherein: the inner wall of the outer screw member (7) is provided with an outer guiding groove (73), the outer wall of the lower portion of the inner screw member (6) is provided with protruding posts (62), the inner screw member (6) is rotatably connected to the outer screw member (7) via the protruding posts (62) and the outer guiding groove (73), the bead (3) comprises a push rod (32) at a lower portion, the inner wall of the inner screw member (6) is provided with an inner guiding groove (61), the outer wall of the lower portion of the push rod (32) is provided with rotating posts (33), and the bead (3) is rotatably connected to the inner screw member (6) via the rotating posts (33) and the inner guiding groove (61).

2. The double-spiral lipstick tube according to claim 1, wherein a coloring member (11) for marking the color of the product is embedded in the center of the top of the cap (1).

3. The double-spiral lipstick tube according to claim 1, wherein the inner wall of the lower portion of the cap (1) is provided with a groove ring (12), and the outer wall of the upper portion of the tube body (8) is evenly distributed with protruding teeth (81) snapped into the groove ring (12).

4. The double-spiral lipstick tube according to claim 1, wherein the outer screw member (7) comprises an upper outer screw member (71) and a lower outer screw member (72) which are connected vertically, the outer wall of the lower outer screw member (72) is provided with a limiting ring (75), and the inner wall of the lower portion of the tube body (8) is provided with a limiting groove (82) into which the limiting ring (75) abuts.

5. The double-spiral lipstick tube according to claim 4, wherein the outer wall of the lower outer screw member (72) is also circumferentially and evenly distributed with outer limiting teeth (76), and the inner wall of the lower portion of the tube body (8) is circumferentially and evenly distributed with inner limiting teeth (83) engaged to the outer limiting teeth (76).

6. The double-spiral lipstick tube according to claim 4, wherein the outer wall of the upper outer screw member (71) is provided with several rib rings (74), the inner wall of the middle segment (5) is provided with several ribs (52), and the rib rings (74) abut vertically against the ribs (52) to form axial limiting of the middle segment (5) by the outer screw member (7).

7. The double-spiral lipstick tube according to claim 1, wherein the bead (3) further comprises a barrel body (31) connected to an upper end of the push rod (32), and the barrel body (31) is located inside the bushing (2).

8. The double-spiral lipstick tube according to claim 1, wherein the lifting member (4) comprises an upper lifting portion (41) and a pair of side lifting portions (42) symmetrically connected to a lower end surface of edge of the upper lifting portion (41), the outer wall of the middle segment (5) is symmetrically provided with a pair of sliding grooves (51), and the lifting member (4) is slidably connected to the middle segment (5) via the side lifting portions (42) and the sliding grooves (51).

* * * * *